US006575232B1

(12) United States Patent
Nakado et al.

(10) Patent No.: US 6,575,232 B1
(45) Date of Patent: Jun. 10, 2003

(54) HEAT EXCHANGER

(75) Inventors: Koji Nakado, Nishi-kasugai-gun (JP); Toru Okamura, Nishi-kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/588,473

(22) Filed: Jun. 7, 2000

(30) Foreign Application Priority Data

Jun. 7, 1999 (JP) ..... 11-160230

(51) Int. Cl.[7] ..... F28F 9/02
(52) U.S. Cl. ..... 165/173; 29/890.044
(58) Field of Search ..... 165/173, 177; 29/890.044, 890.053

(56) References Cited

U.S. PATENT DOCUMENTS 4,458,749 A * 7/1984 Melnyk ..... 165/148
5,579,832 A * 12/1996 Le Gauyer ..... 165/173
5,996,633 A * 12/1999 Kato ..... 138/38
6,073,688 A * 6/2000 Kato ..... 165/177

FOREIGN PATENT DOCUMENTS

JP 6159986 a 6/1994

* cited by examiner

*Primary Examiner*—Allen Flanigan
(74) *Attorney, Agent, or Firm*—Birch, Stewart, Kolasch & Birch, LLP

(57) ABSTRACT

A flat or a flared tubular end portion devoid of dimples is provided at the end of a tube 11 which is to be inserted into a header with the length, of the flat tubular portion being 1.5 mm or less along the direction of the length of the tube to prevent rapid reduction and enlargement of the cross-sectional area of the refrigerant path in the vicinity of the joint of the tube and the header, so as to reduce the pressure loss of the refrigerant which flows in and out from the header to the tube. A tube insertion stop is also provided consisting either, of a cut formed in the longitudinal edge of the flat end portion or a guard member which is formed aft of the flared, end portion so as to abut the header and seal off the tube insertion aperture of the header.

5 Claims, 10 Drawing Sheets

HEAT EXCHANGER

This application is based on Japanese Patent Application No. Hei 11-60230.

BACKGROUND OF THE INVENTION

1. Field of the Invention

The present invention relates to a heat exchanger arranged in an air conditioner for a vehicle or the like.

2. Description of the Related Arts

In a conventional heat exchanger in an air conditioner for a vehicle, a tube for a heat exchanger as shown in FIG. 10 has been used. This tube is manufactured by an extrusion process, then, a plurality of thin tubes are located inside the tube by forming a plurality of partitions 2 in a flat tube 1 when extruding.

Since a tube like the above is molded by extrusion, it is difficult to form the flat tube 1 and the partitions 2 so that they are thin, therefore, some problems have been observed, for example, a large amount of materials for the tube is required, therefore, production costs increase and the heat exchanging property cannot be improved because of the flat tube 1 and the partitions 2 have thick walls.

Recently, a tube for a heat exchanger to take the place of the above extruded tube, a tube such as shown in FIG. 11 has been proposed. A tubular portion 3 as this type of tube is formed by the steps of bending a flat plate in two, forming the upper and lower walls 4*a* and 4*b* roughly in parallel, overlapping the side edges of the upper and lower walls 4*a* and 4*b,* and brazing the overlapped side edges. The tubular portion 3 is characterized in that, since dimples (cavities) 5 are formed on the outer surfaces of the upper and lower walls 4*a* and 4*b,* the dimples 5 protrude inward when the dimples 5 are observed from the inside of the tubular portion 3 and a plurality of columns 6 are formed between the walls 4*a* and 4*b* by closely contacting the inner top of the dimple 5 formed on the either side wall to the inner top of the dimple 5 formed on the other side wall. By arranging the columns 6 in the tubular portion 3, turbulent flow occurs in the refrigerant which runs through the tubular portion 3. Therefore, its heat exchanging property is improved.

According to the dimple tube mentioned above, since the tubular portion is formed by bending a flat plate in two, the walls of the dimple tube can be thin. This provides several advantages, e.g., less material is used in the dimple tube, production costs decrease, and the heat exchanging property is improved. Furthermore, the columns 6 consisting of the dimples 5 are regularly arranged in the dimple tube along the length direction, so that a sufficient amount of pressure is obtained even if the thickness of the walls of the dimple tube are thin. This type of dimple tube will be introduced in air conditioners for vehicles in the future.

FIG. 12 shows a cross section of a part of the heat exchanger using the dimple tube. The ends of dimple tube 7 are inserted into a header 8 having a hollow cylindrical shape through a tube inserting hole 8*a* where they are joined by brazing.

One of the factors determining the heat exchanging property is pressure loss depending on rapid reduction and enlargement of the cross-sectional area of the refrigerant path when, for example, in the joint of the dimple tube 7 and the header 8 shown in FIG. 12, the refrigerant flows into the dimple tube 7 from the header 8 and the refrigerant flows into the header 8 from the dimple tube 7. This is because a plurality of dimples 5 are formed from one end to the other end of the dimple tube in a conventional dimple tube 7 and the columns 6 consisting of the dimples 5 reduce the opening area of the end of the dimple tube 7, so that the cross-sectional area of the refrigerant path is rapidly reduced or enlarged when the refrigerant flows through a joint of the dimple tube 7 and the header 8, therefore, pressure loss is increased.

BRIEF SUMMARY OF THE INVENTION

In the light of the above, an object of the present invention is to provide a heat exchanger wherein rapid reduction and enlargement of the refrigerant path are prevented when the refrigerant flows at the joint of the dimple tube and the header and pressure loss of the refrigerant which flows into and out of the header to the tube is reduced.

To achieve the above object, the present invention provides a heat exchanger comprising a tube containing an upper wall and a lower wall arranged roughly in parallel, an overlap width, a path for a refrigerant, a plurality of protrusions protruding toward the path arranged on at least one of the inner surfaces of the upper and lower walls, and a plurality of columns formed by contacting the tops of the protrusions to the inner surface of the other wall and a header having a hollow cylindrical shape so that both ends of the tube are put into the header through a tube inserting hole and joined by brazing; wherein a flat tubular portion without the protrusions is provided at the end of the tube to be inserted into the header and the length of the flat tubular portion is 15 mm or less along the direction of the length of the tube.

Furthermore, the length of the flat tubular portion may be from 5 to 15 mm.

Moreover, the overlap width may have a cut portion.

In this heat exchanger, since the flat tubular portion without columns is provided at the end of the tube, the opening area of the end of the tube is not reduced thereby. Therefore, rapid reduction and enlargement of the refrigerant path are presented when the refrigerant flows through the vicinity of the joint of the tube and the header and pressure loss of the refrigerant which flows into and out of the header to the tube is reduced.

Furthermore, as to another aspect, the present invention provides a heat exchanger comprising: a tube containing an upper wall and a lower wall arranged roughly in parallel and consisting of a part of a path for a refrigerant, a plurality of protrusions protruding toward the path arranged on at least one of inner surfaces of the upper and lower walls, and a plurality of columns formed by contacting the tops of the protrusions to the inner surface of the other wall and a header having a hollow cylindrical shape in which both ends of the tubes are put into the header through a tube inserting hole and joined by brazing; wherein the tube includes a flared outer end portion and a guard or stop located intermediate the protrusions and the end portion and closing the tube inserting hole by contacting the side of the header when the tube is inserted in the tube inserting hole.

In this heat exchanger, since an expanded tubular portion is provided, the area of the open end of the tube is larger than the cross-sectional area of the refrigerant path in the tube without the expanded tubular portion. Therefore, rapid reduction and enlargement of the cross-sectional area of the refrigerant path are prevented in the vicinity of the joint of the tube and the header and pressure loss of the refrigerant which flows in and out from the header to the tube is reduced. Since the tube inserting hole is required to be larger than the expanded tubular portion, the guard is located at the end of the tube and seals off the tube inserting hole, so that the refrigerant is prevented from leaking.

According to the present invention, since a portion of the tube without columns is provided at the end of the tube, the opening area of the end of the tube is not reduced by the columns. Therefore, rapid reduction and enlargement of the cross-sectional area of the refrigerant path are further prevented at the vicinity of the joint of the tube and the header, and pressure loss of the refrigerant which flows in and out from the header to the tube is reduced.

DETAILED DESCRIPTION OF THE INVENTION

The first embodiment of the heat exchanger of the present invention is described in detail with reference to FIGS. 1 to 6.

Figure 1:
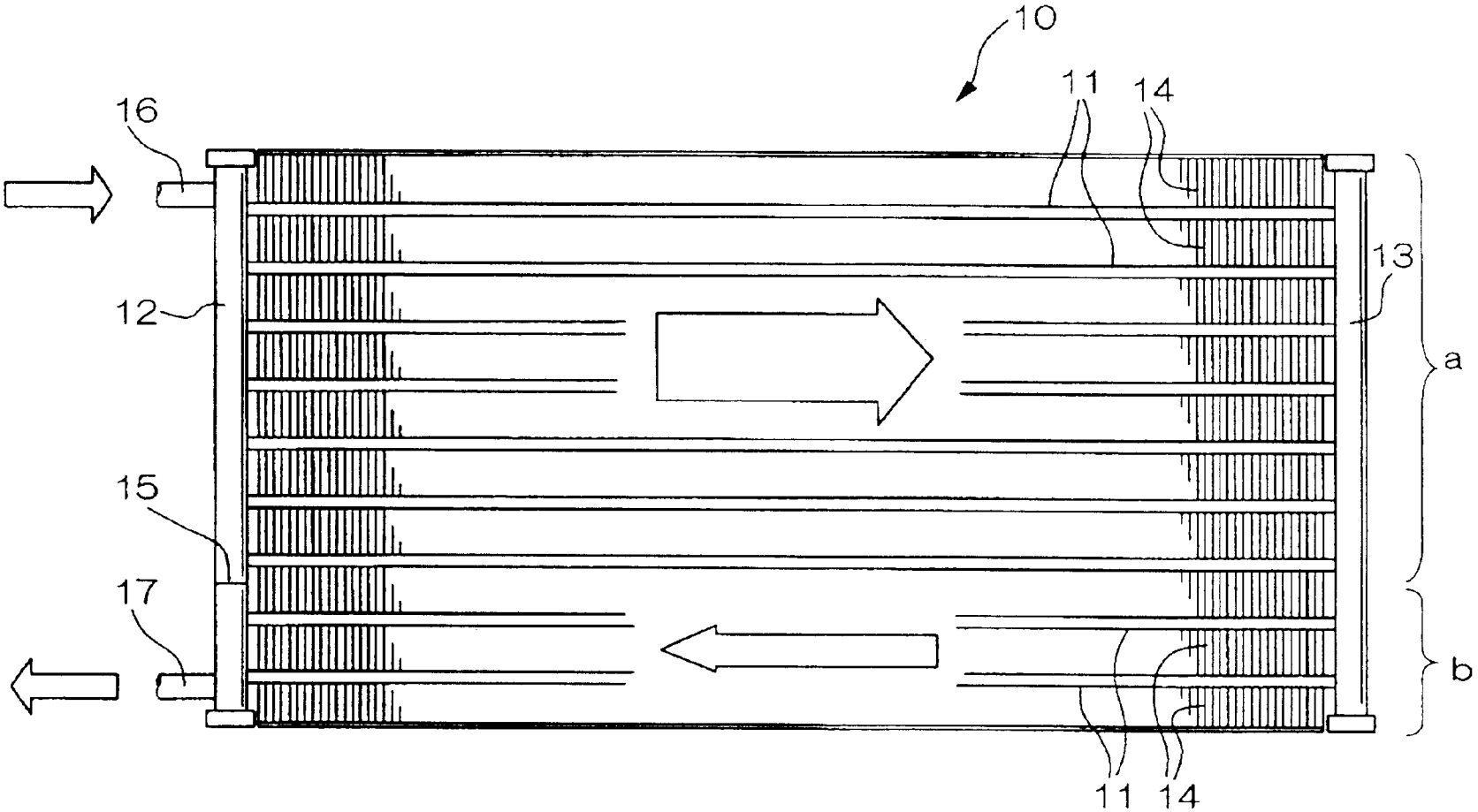
FIG. 1 is a front view of a heat exchanger in accordance with the first embodiment of the present invention.

As shown in FIG. 1, a heat exchanger 10 of the present invention is a parallel flow type heat exchanger and comprises a plurality of flat tubes 11 which are arranged apart from each other roughly in parallel, a pair of headers 12 and 13 which are inserted at both ends of corresponding tube 11 and connect with the refrigerant path in the tube, and fins 14 for cooling which have a corrugated shape and are arranged between the tubes 11.

The header 12 is internally separated into two parts with a partition plate 15 which is arranged below the center of the header 12. In the upper part of the header 12, a refrigerant inlet pipe 16 is connected to the header 12. In the lower part of the header 12, a refrigerant outlet pipe 17 is connected to the header 12. Therefore, as shown by the arrows in FIG. 1, the refrigerant passing through the tube 11 flows from the header 12 to the header 13 in the area a above the partition plate 15 and flows from the header 13 to the header 12 in the area b below the partition plate 15.

Figure 2:
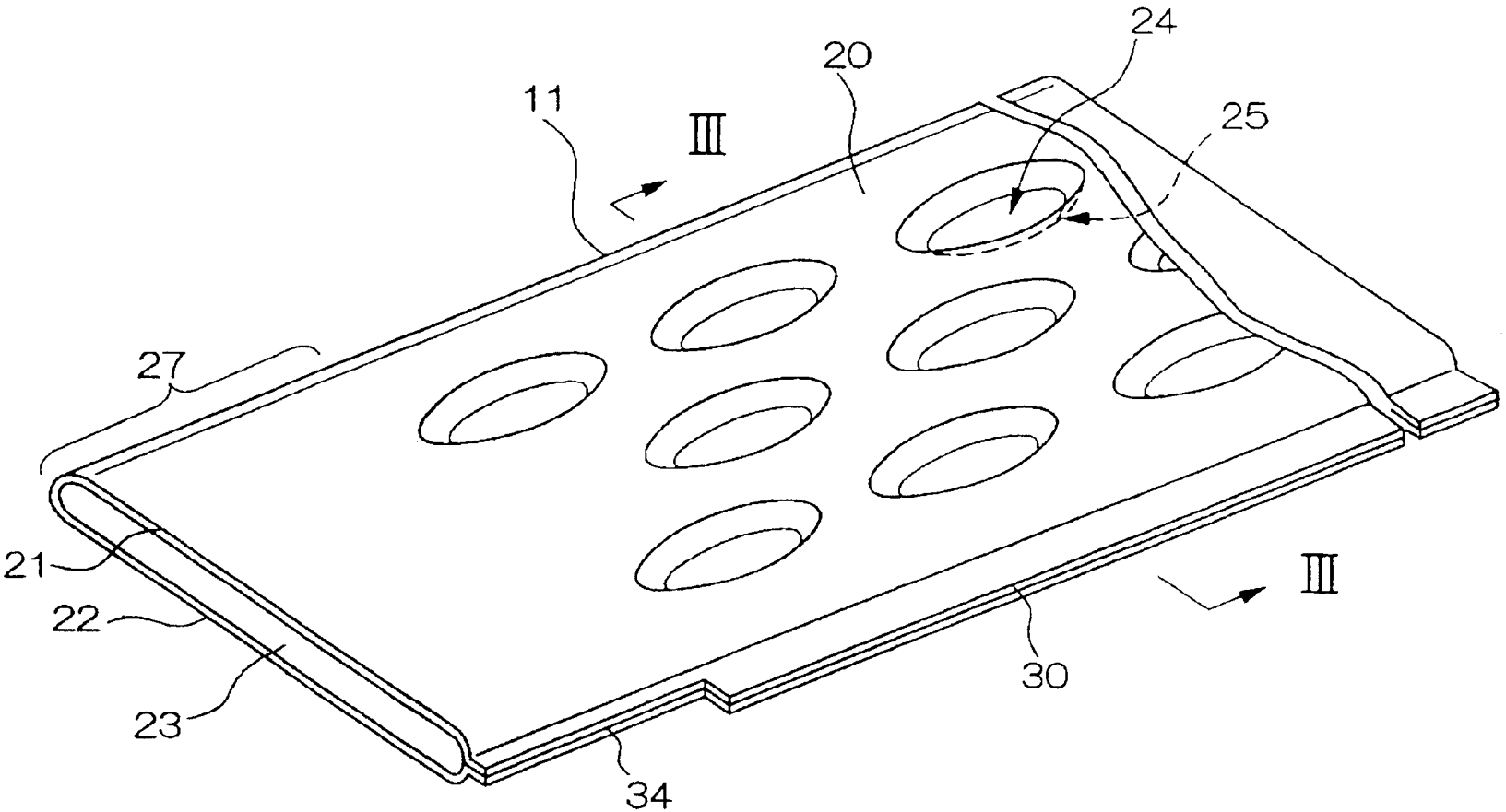
FIG. 2 is a perspective view of a tube for the heat exchanger shown in FIG. 1.

As shown in FIG. 2, the tube 11 is formed by bending a flat plate 20 in two, forming the upper and lower walls 21 and 22 roughly in parallel, and brazing the overlapping side edges of the upper and lower walls to each other so as to form a tubular shape. In the tube 11, the upper wall 21 and the lower wall 22 are separated from each other roughly in parallel and a refrigerant path 23 is formed between the upper and lower walls 21 and 22.

Furthermore, in the tube 11, dimples 24 are formed by pressing the upper and the lower walls 21 and 22 inwardly from the outside. When these dimples 24 are formed, a plurality of inward protrusions 25 are formed at the walls 21 and 22, that is, in the refrigerant path 23.

Figure 3:
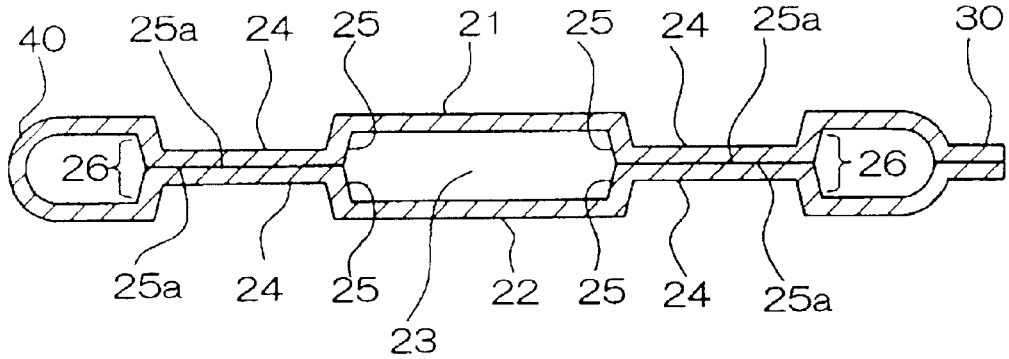
FIG. 3 is a cross-sectional view taken on line III—III in FIG. 2.

These protrusions 25 are elliptical in shape, having their larger diameter along the length direction when the walls 21 and 22 of the tube 11 are observed in a plane view. Furthermore, as shown in FIG. 3, since opposing surfaces 25*a* are in mutual contact, a column 26 whose transverse cross-section is also elliptical in shape is provided between the upper and lower walls 21 and 22. The shape of the column 26 may be not only an ellipse, but also a circle or a race track shape.

Figure 4:
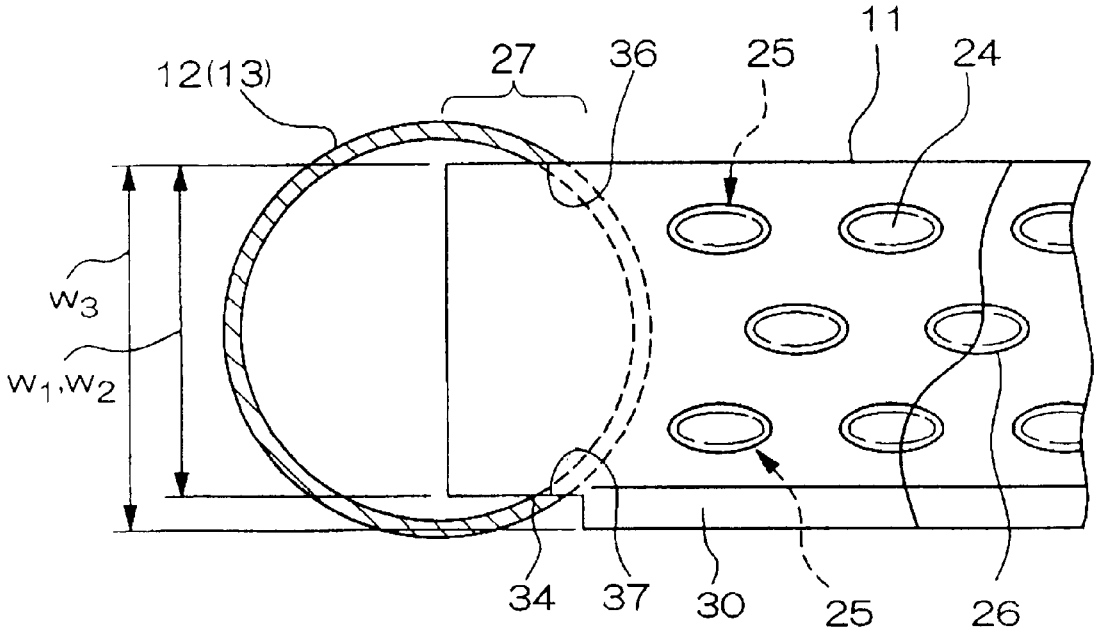
FIG. 4 is a traverse sectional view of a joint of a header and a tube.

As shown in FIG. 4, the protrusions 25 are arranged so that two protrusions obliquely arrayed adjacent to each other along the length direction of the tube 11 are partly overlapped along the length direction of the tube 11, so that the protrusions 25 on the tube 11 form a zigzag-like pattern. Similarly, protrusions 25 are also provided in the other tubes and columns 26 are formed by this arrangement. Furthermore, the end of the tube 11 to be inserted into the header 12 is flat without any columns 26 so as to provide a flat tubular portion 27 whose inner walls do not have an irregular shape.

As shown in FIGS. 2 and 4, the tube 11 includes an overlap width 30 which is brazed at the side edges of the tube 11. A part of the end of the overlap width 30 is cut off so as to provide a cut portion 34 so that both ends of the tube 11 can be inserted into the headers 12 and 13 respectively. On the other hand, a plurality of tube inserting holes 36 whose shapes are the same as the shape of the end of the tube 11 are formed at the header 12 for receiving other tubes therein. Furthermore, a groove 37 is formed at one side of these tube inserting holes 36 so as to receive the cut portion 34 of the overlap width 30 in the header 12.

The width $w_1$ of the tube inserting hole 36 is approximately the same as the width $w_2$ of the tube 11 comprising the cut portion 34 and the width $w_3$ of the tube 11 comprising the overlap width 30 is wider than the width $w_1$ or $w_2$. Accordingly, when the end of the tube 11 is inserted into the tube inserting hole 36, the step between the overlap width 30 and the cut portion 34 touches the surface of the header 12, therefore, the overlap width 30 cannot be further inserted and thus acts as a stop.

Next, a manufacturing process of the heat exchanger 10 having the above structure is described in detail with reference to FIG. 5.

Figure 5B:
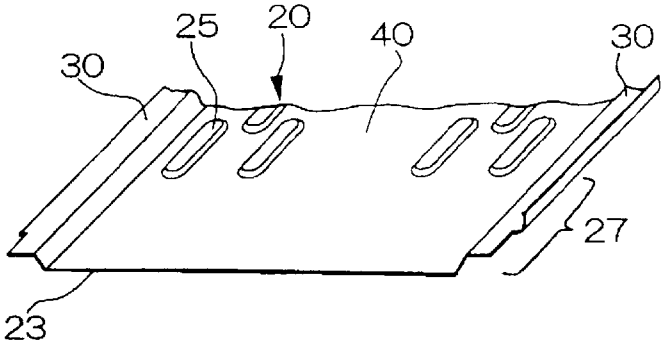
FIGS. 5A–5D are illustrative of the manufacturing process for producing the heat exchanger shown in FIG. 1.
Figure 5D:
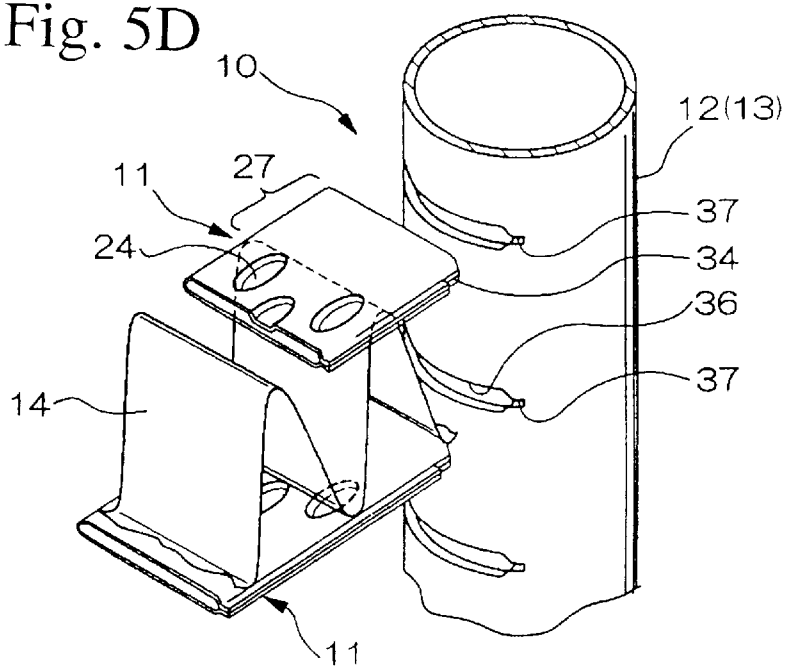
Figure 5A:
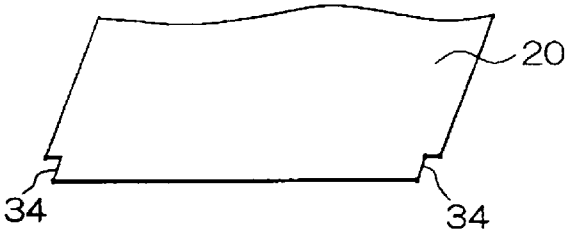

As shown in FIG. 5A, a flat plate 20 is prepared to form the tube 11, a brazing filler metal is clad on both surfaces of the flat plate 20, and the cut portion 34 is formed at the edges of the flat plate 20. The cut portion 34 is formed after bending the flat plate 20 in two.

As shown in FIG. 5B, protrusions 25 are formed in the flat plate 20 by press molding or roll molding so that the protrusions 25 are formed at the inside of the tube 11. A width for bending 40 is formed at a bending portion, and the overlap widths 30 are formed at both edges of the tube 11. The protrusions 25 are not formed at the outer end portion 27.

Figure 5C:
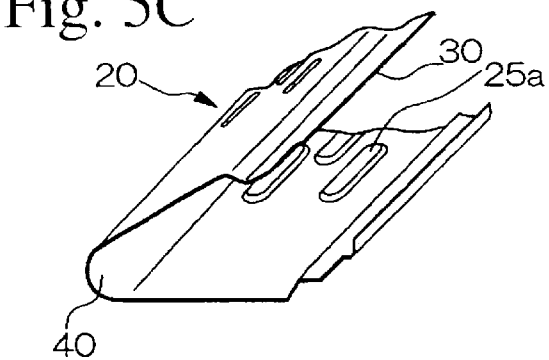

As shown in FIG. 5C, the flat plate 20 is bent in two along the width 40 for bending. The flat plate 20 bent in two now becomes the tube 11 having a flat shape by putting together the overlap widths 30 and the tops 25*a* of the protrusions 25 so they face each other.

As shown in FIG. 5D, the header 12(13) including the tube inserting hole 36 is prepared and the end of the tube 11, namely, the flat tubular portion 27, is inserted into the header 12(13). During assembly of the heat exchanger 10, corrugated fins 14 are fitted between tubes 11. The assembled heat exchanger 10 is next put into a furnace (not shown) and heated to a predetermined temperature for a predetermined time, so that the brazing filler metal clad onto the flat plate 20 fuses and brazes each portion of the heat exchanger 10, that is, both overlap widths 30, the tops 25 of the protrusions 25 facing each other, both ends of the tube 11 and the tube inserting holes 36 of the header 12 (13), and the portions where the tube 11 and the corrugated fins 14 touch each other are brazed. The fabrication of the heat exchanger 10 is now complete.

Figure 6:
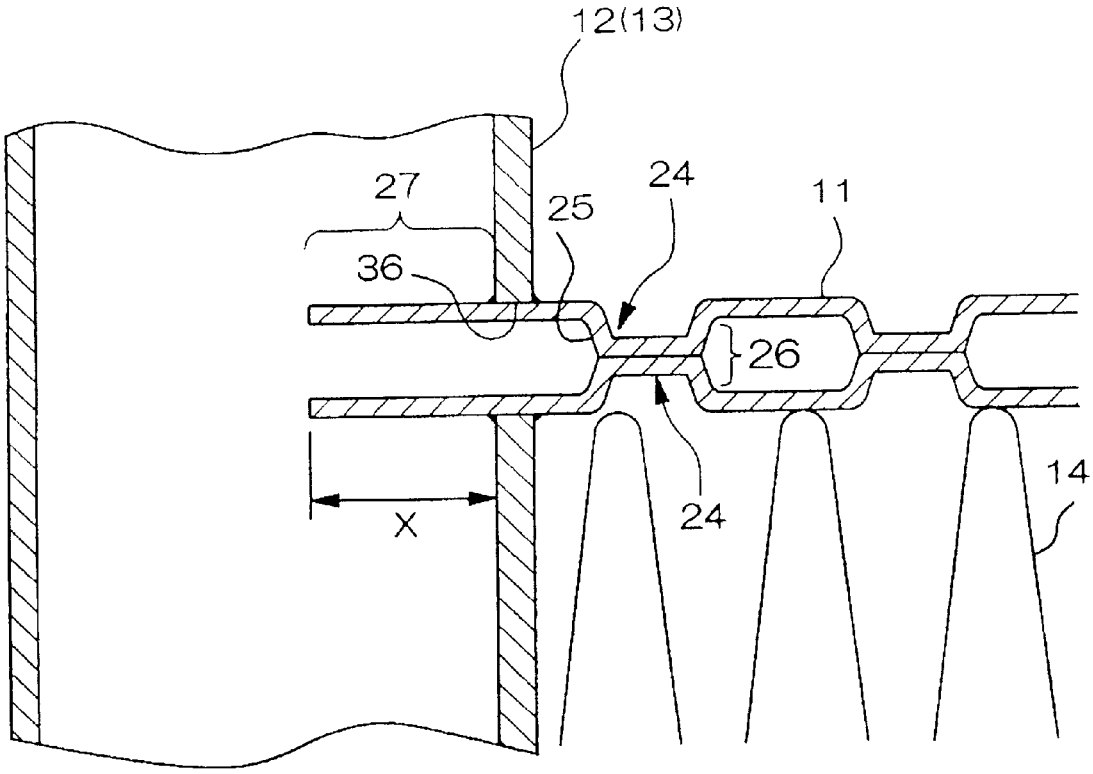
FIG. 6 is a longitudinal cross-sectional view of a joint of the header and the tube shown in FIG. 5D.

In the heat exchanger 10 prepared by the above process, as shown in FIG. 6, since the flat tubular portion 27 without columns 26 is located at the end of the tube 11 so as to be inserted into the header 12 (13), the area of the opening at the end of the dimple tube 7 inserted in the header is not narrow but relatively wide as shown. On the other hand, the area of the opening at the end of the conventional dimple tube is relatively narrow. Accordingly, rapid reduction and enlargement of the cross-sectional area of the refrigerant path 23 is prevented and pressure loss is reduced.

The length X of the flat tubular end portion 27 is preferably 15 mm or less, more preferably, 5 mm$\leqq$X$\leqq$15 mm. If the length X is more than 15 mm, the deterioration of the heat exchanging property due to the decreased number of dimples 24 (protrusions 25) is bigger than the effect of reduction of the pressure loss, and if the length X is less than 5 mm, the opening area of the tube 11 is narrowed because the columns 26 approach the end of the tube 11.

Figure 7:
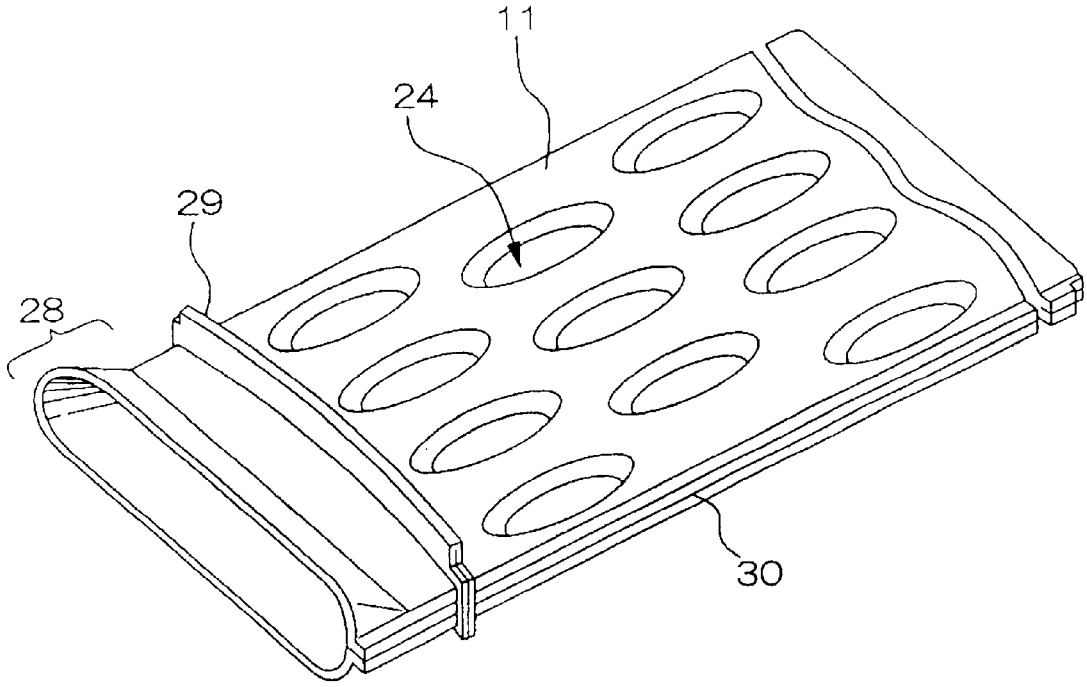
FIG. 7 is a perspective view of a tube for the heat exchanger in accordance with a second embodiment of the present invention.

The second embodiment of the heat exchanger of the present invention will be described in detail with reference to FIGS. 7 to 9. The elements in the second embodiment already described in the above first embodiment are given the same reference numbers and the explanations of these elements are omitted.

In the heat exchanger 10 of the second embodiment, an end portion having no columns 26 is located at the end of the tube 11 where it is to be inserted into the header 12 (13). An expanded tubular portion 28 which is flared so as to have a funnel-shape and which gradually expands toward the end of the tube 11 is formed thereat, and a guard 29 which also acts as a tube insertion stop is fitted onto the end portion having no columns 26 between the expanded tubular portion 28 and the tube 11 having columns 26. The guard 29 seals off the tube inserting hole 36 by closely contacting the side of the header 12 (13). The expanded tubular portion 28 and the guard 29 are formed by molding the flat plate. 20 using press molding or roll molding similar to the protrusions 25 or the like. Furthermore, the guard 29 may be formed by welding the other member at the end of the tube 11 using bead molding.

The tube inserting hole 36 is formed so as to have the same size as the circumference of the expanded tubular portion 28 to be inserted into the header 12. Furthermore, the guard 29 is formed to be larger than the expanded tubular portion 28 and has the same shape as the curved shape of the header 12 (13) so as to completely seal the tube inserting hole 36 by the guard 29.

Figure 8:
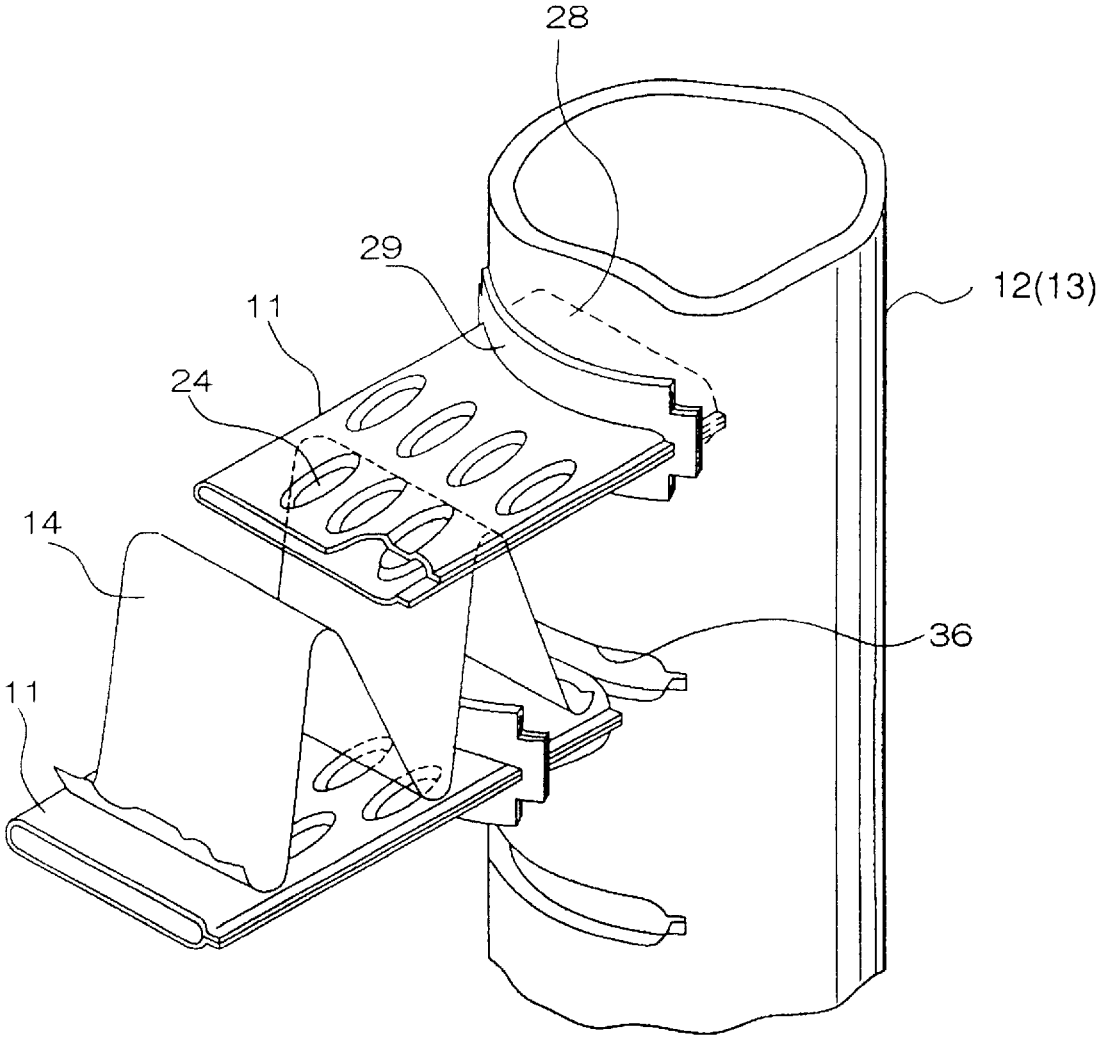
FIG. 8 is a perspective view of a joinder of a header and a tube for the heat exchanger shown in FIG. 7.

The tube 11 comprising the expanded tubular portion 28 mentioned above is arranged so that the guard 29 contacts the surface of the header 12 as shown in FIG. 8 when the heat exchanger 10 is assembled. Heating the tube 11 in the furnace, the brazing filler metal fuses and brazes the guard 29 and the header 12 as well as the other portions for brazing so that the tube inserting hole 36 is sealed.

Figure 9:
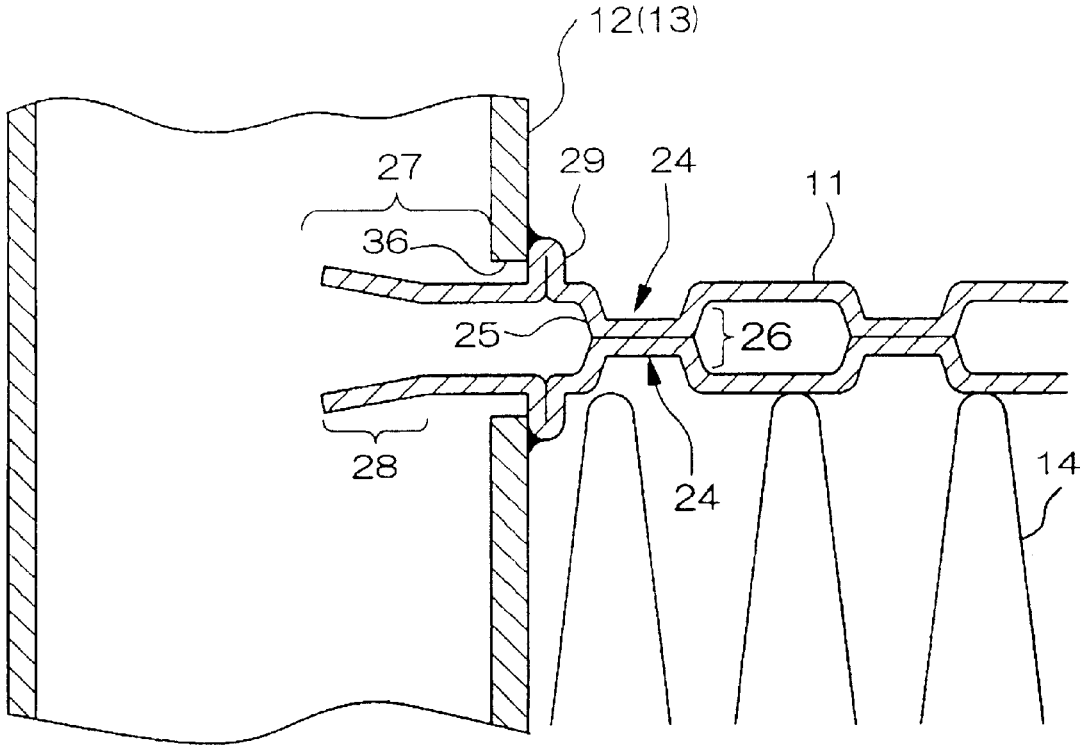
FIG. 9 is a longitudinal cross-sectional view of the joinder of the header and the tube for the heat exchanger shown in FIG. 8.
Figure 10:
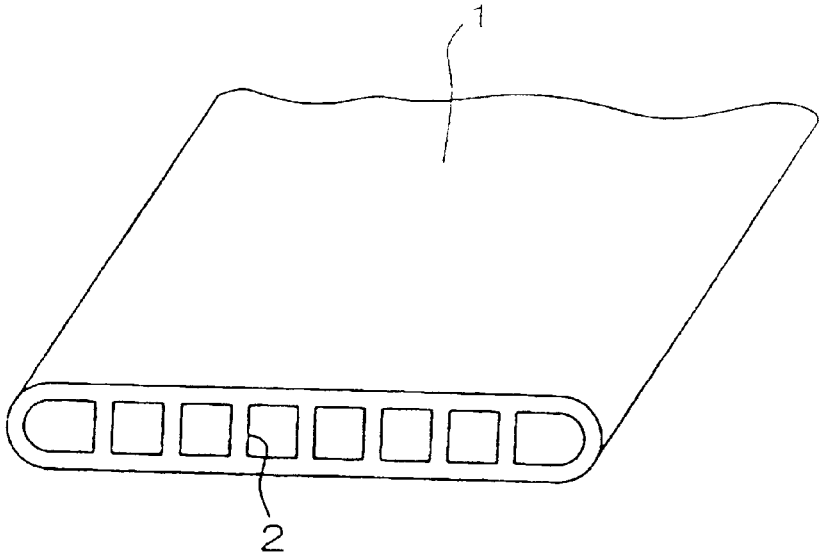
Fig. 10 CONVENTIONAL ART
FIG. 10 is a perspective view of an example of a conventional extrusion molding tube for a heat exchanger.
Figure 11:
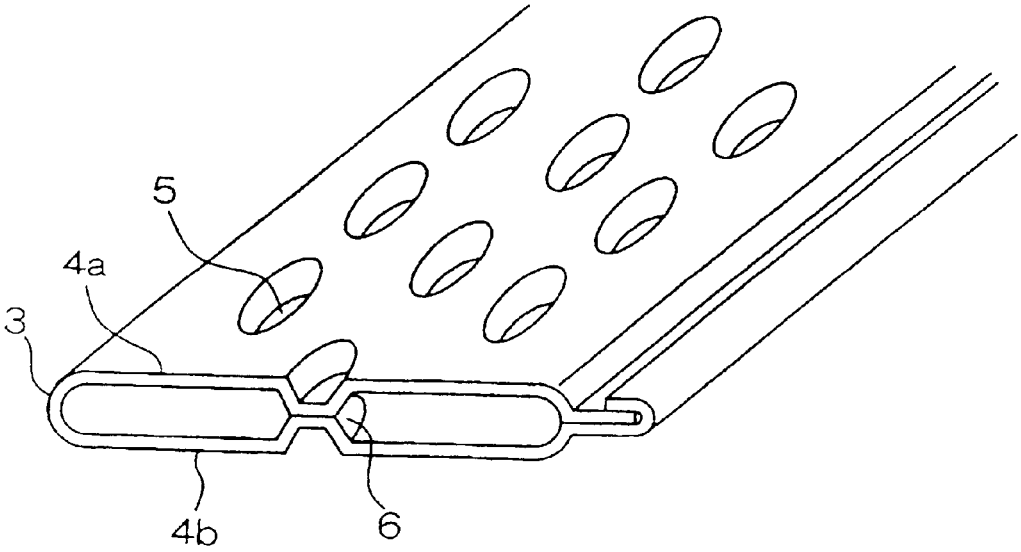
Fig. 11 CONVENTIONAL ART
FIG. 11 is a perspective view of an example of a conventional dimpled tube.
Figure 12:
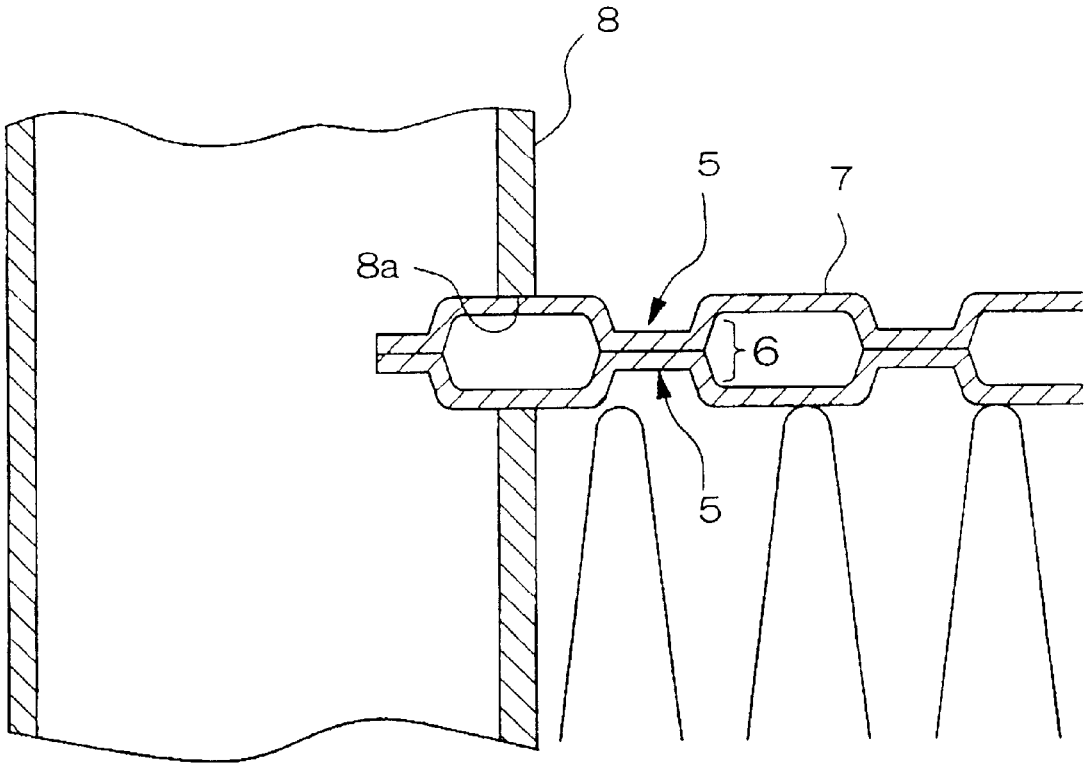
FIG. 12 is a longitudinal cross-sectional view of a joint of a header and a dimple tube shown in FIG. 11.

In the heat exchanger 10 formed according to the above and as shown in FIG. 9, by providing an expanded tubular portion 28 at the end of the tube 11 which is to be inserted into the header 12 (13), the area of the opening of the tube 11 is formed larger than the cross-sectional area of the remaining refrigerant path 23. Moreover; since the expanded tubular portion 28 is formed in a funnel-shape, rapid reduction and enlargement of the refrigerant path 23 is prevented and pressure loss is reduced.

Furthermore, the guard 29 forms an integral portion of the tube 11 in the second embodiment and is adapted to close the tube inserting hole 36 when the heat exchanger 10 assembled and brazed so as to seal the tube inserting hole 36.

What is claimed is:

1. A heat exchanger comprising:

a tube containing an upper wall and a lower wall arranged roughly in parallel and consisting of a part of a path for a refrigerant, a plurality of protrusions protruding toward the path arranged on at least one of the inner surfaces of the upper and lower walls, and a plurality of columns formed by contacting the tops of the protrusions with the inner surface of the other wall; and a header having a hollow cylindrical shape in which both ends of the tube are put into the header through a tube inserting hole and joined by brazing;

wherein the tube includes a flared outer end portion and a guard or stop located intermediate the protrusions and the flared outer end portion sealing the tube inserting hole by contacting the side of the header when the flared outer end portion of the tube is inserted in the tube inserting hole, wherein a tube end is inserted in the tube hole, which hole is of a size corresponding to the maximum circumference of the flared portion, with a unflared portion of the tube end received in a slot of the header being substantially smaller in circumference so as to define a clearance between the wall of the tube and the slot.

2. A heat exchanger according to claim 1 wherein the guard is located about 15 mm or less from a distal end of the flared outer end portion.

3. A heat exchanger according to claim 1 wherein the guard comprises an integral part of the tube.

4. A heat exchanger according to claim 1 wherein the protrusions and columns are generally elliptical in shape.

5. A heat exchanger according to claim 4 wherein the protrusions and columns are arranged in a generally zigzag fashion or in rows along the length of the tube.

* * * * *